US009231315B2

(12) United States Patent
Feye-Hohmann

(10) Patent No.: US 9,231,315 B2
(45) Date of Patent: Jan. 5, 2016

(54) ELECTRICAL SPIKE CONNECTOR

(71) Applicant: Phoenix Contact GmbH & Co. KG, Blomberg (DE)

(72) Inventor: Jürgen Feye-Hohmann, Detmold (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 15 days.

(21) Appl. No.: 14/365,157

(22) PCT Filed: Dec. 20, 2012

(86) PCT No.: PCT/EP2012/076340
§ 371 (c)(1),
(2) Date: Jun. 13, 2014

(87) PCT Pub. No.: WO2013/102571
PCT Pub. Date: Jul. 11, 2013

(65) Prior Publication Data

US 2014/0311800 A1 Oct. 23, 2014

(30) Foreign Application Priority Data

Jan. 4, 2012 (DE) ..... 10 2012 000 079

(51) Int. Cl.
*H01R 4/66* (2006.01)
*H01R 4/24* (2006.01)
(Continued)

(52) U.S. Cl.
CPC ..... *H01R 4/2404* (2013.01); *H01R 12/616* (2013.01); *H01R 12/67* (2013.01); *H01R 13/7175* (2013.01)

(58) Field of Classification Search
CPC ..... H01R 4/64; H01R 25/142
USPC ..... 439/92, 94, 927, 387, 435, 877
See application file for complete search history.

(56) References Cited

U.S. PATENT DOCUMENTS 4,173,035 A 10/1979 Hoyt
5,036,164 A * 7/1991 Schrader ..... H01R 4/186 174/7

(Continued)

FOREIGN PATENT DOCUMENTS

DE 29505242 U1 5/1995
EP 1313172 A1 5/2003

(Continued)

OTHER PUBLICATIONS

German examination report, dated Nov. 15, 2012, on German Application No. 10 2012 000 079.0 filed on Jan. 4, 2012.

(Continued)

*Primary Examiner* — Phuongchi T Nguyen
(74) *Attorney, Agent, or Firm* — Mannava & Kang, P.C.

(57) ABSTRACT

The invention relates to an electrical spike connector for electrically contacting a first electrical conducting track of a first electrical line piece (211), said first electrical conducting track being insulated by means of an insulating layer, comprising a socket element (101) having a first conductive spike (105) and comprising a socket mating element (103) for retaining the first electrical line piece, wherein the first conductive spike (105) of the socket element (101) can be pressed against the first electrical line piece retained in the socket mating element (103) in order to pierce the insulating layer and to electrically contact the first electrical conducting track.

22 Claims, 8 Drawing Sheets

(51) Int. Cl.

| | |
|---|---|
| ***H01R 12/61*** | (2011.01) |
| ***H01R 12/67*** | (2011.01) |
| *H01R 13/717* | (2006.01) |

(56) References Cited

U.S. PATENT DOCUMENTS

| | | | | |
|---|---|---|---|---|
| 7,670,153 | B2 * | 3/2010 | Kulig | H01R 4/26 439/432 |
| 7,717,387 | B2 * | 5/2010 | Naheem | B60M 5/00 238/14.4 |
| 7,988,464 | B2 * | 8/2011 | Kossak | F16B 2/065 439/803 |
| 8,025,508 | B2 * | 9/2011 | Parker | H01R 4/36 439/92 |
| 2008/0081507 | A1 | 4/2008 | Mahajan | |
| 2010/0197164 | A1 | 8/2010 | Enomoto et al. | |
| 2010/0279539 | A1 | 11/2010 | Lo et al. | |
| 2011/0045704 | A1 | 2/2011 | Li et al. | |

FOREIGN PATENT DOCUMENTS

| | | | |
|---|---|---|---|
| JP | 2001118621 | A | 4/2001 |
| WO | WO-2006/000154 | A1 | 1/2006 |
| WO | 2010082967 | | 7/2010 |

OTHER PUBLICATIONS

International Search Report for international application No. PCT/EP2012/076340, Mar. 4, 2013.

* cited by examiner

ELECTRICAL SPIKE CONNECTOR

PRIORITY

The present application claims priority under 35 U.S.C. §371 to PCT Application PCT/EP2012/076340 filed on Dec. 20, 2012, which claims priority to German Patent Application No. 10 2012 000 079.0, filed on Jan. 4, 2012, the disclosures of which are hereby incorporated by reference in their entireties.

The present invention relates to an electrical spike connector for contacting at least one insulated line piece.

In order to electrically contact insulated conducting tracks of electrical line pieces, for example of electrical connection cables, the insulating layer surrounding the electrical conducting track usually has to be removed first. However, this is complex in the industrial environment and therefore costly.

If the electrical conducting tracks are striplines of an LED band, in which the electrical conducting tracks contact LED lamps, the stripping of the conducting tracks, which are generally very flat, is not easy and is associated with a certain risk of damage to a conducting track.

Once the conducting tracks have been stripped, these can be electrically connected, for example by soldering or screwing. After this, the connection generally has to be electrically insulated again so as to avoid the risk of an electrical leak.

A number of complex process steps are thus necessary for the electrical contacting of insulated electrical conducting tracks.

The object of the present invention is therefore to create a simpler concept for the connection of insulated conducting tracks.

This object is achieved by the features of the independent claims. Advantageous developments are disclosed in the dependent claims, the description and the accompanying drawings.

The present invention is based on the finding that the above object can be achieved by a spike connection comprising at least one conductive spike. The conductive spike is used, in one process step, to break through an insulation of an electrical conducting track and to contact the electrical conducting track, for example likewise by breaking through. The stripping and the electrical contacting of the electrical conducting track can thus be performed in a single process step.

If the conductive spike is used for example on a base element, which may be a base plate, and if a base mating element is used to retain an electrical line piece comprising the electrical conducting track, the stripping and the production of the electrical connection can thus be performed in one step by bringing together the base element and the base mating element. If the base element and the base mating element are produced for example from a non-conductive material, such as plastic, an insulation and/or sealing of an electrical connection can thus be performed when these elements are brought together and connected, whereby a further process step can be saved.

In accordance with a first aspect, the invention relates to an electrical spike connector for electrically contacting a first electrical conducting track of a first electrical line piece, said first electrical conducting track being insulated by means of an insulating layer, comprising a base element having a first conductive spike, a base mating element for retaining the first electrical line piece, wherein the first conductive spike of the base element can be pressed against the first electrical line piece retained in the base mating element in order to pierce the insulating layer and to electrically contact the first electrical conducting track.

The electrical conducting track may be a rectangular strip conducting track for example, of which the thickness is smaller than the width thereof.

In accordance with one embodiment a surface of the base element facing the electrical line piece and/or a surface of the base mating element facing the electrical line piece is provided with flowable plastic, in particular with plastic containing silicone, so as to receive the electrical line piece in a manner surrounding said electrical line piece at least partially.

A cut edge of the electrical line piece is thus advantageously insulated with respect to moisture.

By way of example, the base mating element may have a line piece receptacle, which forms a receiving space for an end of a line piece or for ends of line pieces. This receiving space for example can be prefabricated or provided on-site by a user with the flowable plastic, for example by means of injection. When inserting or introducing the respective electrical line piece into the receiving space by the respective end-face cut edge, the flowable plastic is compressed or pushed together and thus surrounds the end-face cut edge of the line piece in an insulating manner.

In accordance with one embodiment the first conductive spike is designed to deform, for example to break through or press into, the first electrical conducting track so as to produce an electrical contact. As a result of the deformation, a contact area is produced between the conductive spike and the first electrical conducting track.

In accordance with one embodiment the first conductive spike has a spike tip for piercing or breaking through the first electrical conducting track so as to produce the electrical contact.

In accordance with an alternative embodiment the first conductive spike is designed to form a breakthrough-free cavity, in particular a breakthrough-free cavity at least partly surrounding the first conductive spike, in the first electrical conducting track so as to produce the electrical contact. The first conductive spike thus presses an indentation into the first electrical conducting track without necessarily breaking through said first electrical conducting track. The side walls, thus produced, of the cavity or of the recess at least partly surround the conductive spike and contact said spike, whereby an electrical connection is produced.

In accordance with one embodiment the first conductive spike can be pressed against the first electrical line piece retained in the base mating element by bringing together the base element and the base mating element. The base element and the base mating element can be pressed against one another manually for example so as to produce the electrical connection.

In accordance with one embodiment the first conductive spike can be pressed against the first electrical line piece retained in the base mating element by bringing together the base element and the base mating element. As a result of the latched connection, a connection is enabled between the base element and the base mating element when these elements are brought together, whereby the connection can be produced particularly easily. The base element and the base mating element can be fabricated from a non-conductive material, for example from plastic, such that, with a connection between the base element and the base mating element, an insulation of the point of contact with the conductive spike can be produced.

In accordance with one embodiment the base element has a spring on each side, wherein the base mating element has a groove on each side, and wherein each spring can be latched into a groove. As a result of the groove/spring connection, a connection that can be clicked into place between the base element and the base mating element is produced on the one hand. On the other hand the base element can be fixed in a manner secured against tipping.

In accordance with one embodiment the base mating element can be fastened laterally on the base element in a foldable manner, in particular by means of at least one resilient connection tab or at least one hinge. The base element and the base mating element can be brought together by means of a rotatable movement of the base mating element or of the base element about the lateral axis of rotation.

In accordance with one embodiment the base mating element is provided with a second electrical conducting track, which is insulated by means of a second insulating layer, in order to retain a second electrical line piece, wherein the base element has a second conductive spike, which can be pressed against the second electrical line piece retained in the base mating element in order to pierce the second insulating layer and in order to electrically contact the second electrical conducting track, wherein the first conductive spike and the second conductive spike are electrically connected and are provided to electrically connect the first electrical conducting track and the second electrical conducting track. A simultaneous electrical contacting of a number of conducting tracks is thus made possible advantageously in a simple manner.

In accordance with one embodiment the first conductive spike and the second conductive spike are arranged opposite one another. The first conductive spike and the second conductive spike are preferably conductively connected in order to produce an electrical connection between each of the contacted conducting tracks.

In accordance with one embodiment the first electrical line piece has an insulated third electrical conducting track, the second electrical line piece has an insulated fourth electrical conducting track, and the base element has a third conductive spike for electrically contacting the insulated third electrical conducting track and a fourth conductive spike for electrically contacting the insulated fourth electrical conducting track, wherein the third and the fourth conductive spike are conductively connected. A simultaneous contacting of a plurality of adjacently arranged conducting tracks of different line pieces is thus advantageously enabled. By way of example, the two conducting tracks of an LED band, by means of which an LED lamp is supplied with electrical energy, can thus be contacted simultaneously.

In accordance with one embodiment the base element has an electrical connector that is conductively connected to the respective conductive spike and is provided for contacting the respective electrical conducting track. An electrical connection is ensured externally by means of the electrical connector.

In accordance with one embodiment the base mating element has at least one guide recess for guiding the respective conductive spike. The guide recess or the guide recesses ensures/ensure that the respective conductive spike either breaks through the electrical conducting track at a predetermined location or deforms the electrical conducting track at a predetermined location.

In accordance with one embodiment the base mating element descends laterally to the respective side in a dome-like manner. An at least partly elliptical cross section of a housing comprising the base element and the base mating element is thus produced.

In accordance with one embodiment the base mating element has a line piece receptacle for receiving the respective electrical line piece. The respective electrical line piece is fixed at a defined location by the line piece receptacle.

In accordance with one embodiment an insertable insulation leaf is provided in order to insulate an end face of the respective electrical conducting track with respect to moisture. As a result of the insulation leaf or as a result of the insulation leaves, cut edges of the respective electrical conducting tracks can be terminated in an insulating manner. The insulation leaf can be formed for example from flowable plastic, which may comprise silicone, so as to surround the end-face cut edges of the respective line piece. When inserted, the end face of the respective line piece partly penetrates the insulation leaf, whereby the insulating effect is achieved.

In accordance with one embodiment the respective conducting track is a strip conducting track.

In accordance with one embodiment the base element and the base mating element form a pocket-shaped housing when brought together, in particular a water-tight housing. To this end, the base element and/or the base mating element may each be provided with an insulating layer, for example with flowable plastic of the aforementioned type, so as to prevent an infiltration of water into the interior of the pocket-shaped housing. The pocket-shaped housing may also act in an electrically insulating manner.

In accordance with a further aspect, the invention relates to the use of the electrical spike connector according to the invention for contacting at least one strip-shaped conducting track of an LED band.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

BRIEF DESCRIPTION OF THE DRAWINGS

Further exemplary embodiments will be explained with reference to the accompanying drawings, in which.

It is to be understood that both the foregoing general description and the following detailed description are exemplary and explanatory only, and are intented to provide an explanation of various embodiments of the present teachings.

DETAILED DESCRIPTION

Figure 1:
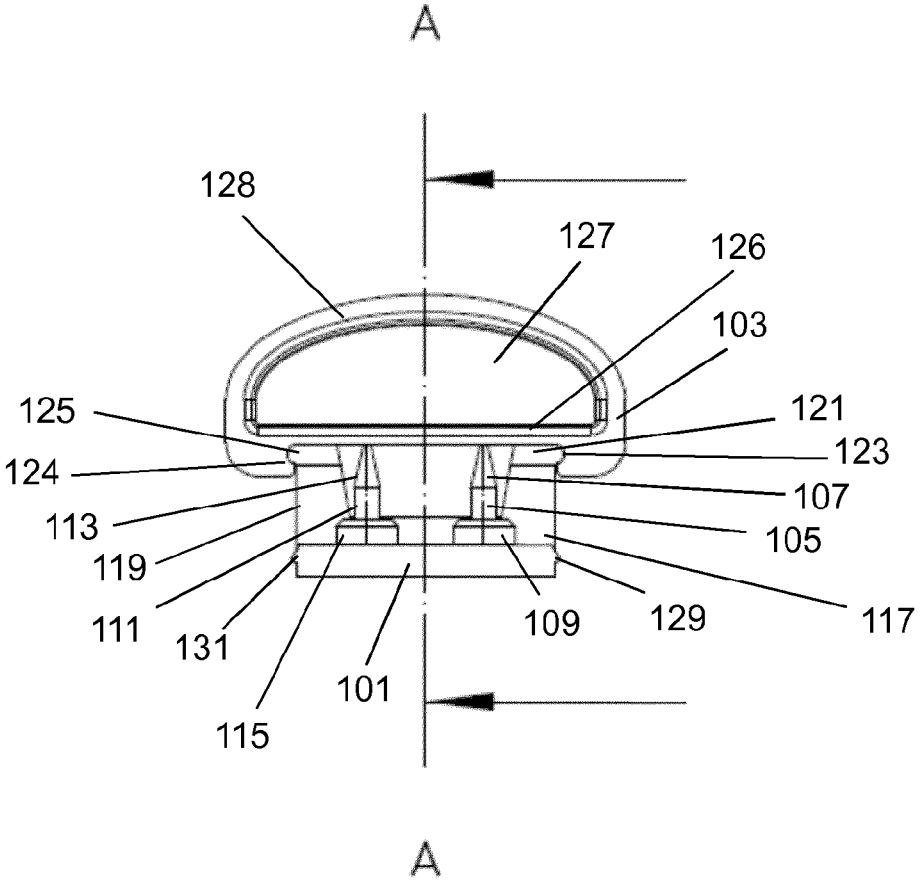
FIG. 1 shows a cross section along the line A-A of an electrical spike connector.

FIG. 1 shows a cross-sectional view of an electrical spike connector, which has a base element 101 and a base mating element 103. The base element 101 comprises a first conductive spike 105, which has a tapered portion 107, for example a spike tip. The first conductive spike 105 is fastened in a spike receptacle 109 of the base element 101. The spike receptacle 109 can be formed as a pedestal with a recess for receiving a spike end.

The base element 101 may have a second conductive spike, which is not illustrated in FIG. 1 and which is electrically connected to the first conductive spike 105. The first conductive spike 105 and the second conductive spike by way of example may contact conducting tracks of different electrical line pieces.

In accordance with one embodiment the electrical spike connector may contact electrical line pieces having a plurality of adjacently arranged electrical conducting tracks, for example two such conducting tracks. To this end, the base element 101 comprises a third conductive spike 111 having a tapered portion 113, for example a spike tip. The third conductive spike 111 is fastened in a spike receptacle 115.

The base element 101 comprises connection portions 117, 119 on each side, which each have a spring 121, 123 for a spring/groove connection or for a latched connection to the base mating element 103. To this end, the base element 103 comprises lateral grooves 124, 125, with which the springs 121, 123 engage.

The base element 103 comprises a line piece receptacle 127, which is provided to receive a line piece. The line piece receptacle 127 may have recesses for guiding the conductive spikes 105, 111. The line piece is guided here in an intermediate space 128 of the base mating element 127. The intermediate space 128 is delimited upwardly by a wall that descends in a dome-like manner on each side.

The line piece receptacle 127 forms a receiving space for an end of a line piece or for ends of line pieces. This receiving space for example can be prefabricated or provided on-site by a user with the flowable plastic, for example by means of injection. When the respective electrical line piece is inserted or introduced into the receiving space by the respective end-face cut edge, the flowable plastic is compressed or pushed together and thus surrounds the end-face cut edge of the respective line piece in an insulating manner.

The side portions 117, 119 can be guided through the intermediate space 128 when the base element 101 and the base mating element 103 are brought together, and can be latched into recesses in the wall of the base mating element. To this end, the portions 117, 119 may be positioned externally and can be pressed inwardly for the purpose of latching. The base element 101 may also have lateral springs 129 and 131. The lateral springs 129, 131, which can also be formed as detent protrusions, engage with the grooves 124, 125 in the base mating element 103 when the base element 101 and the base mating element 103 are brought together. A stable connection of the base element 101 and of the base mating element 103 is thus produced.

Figure 2:
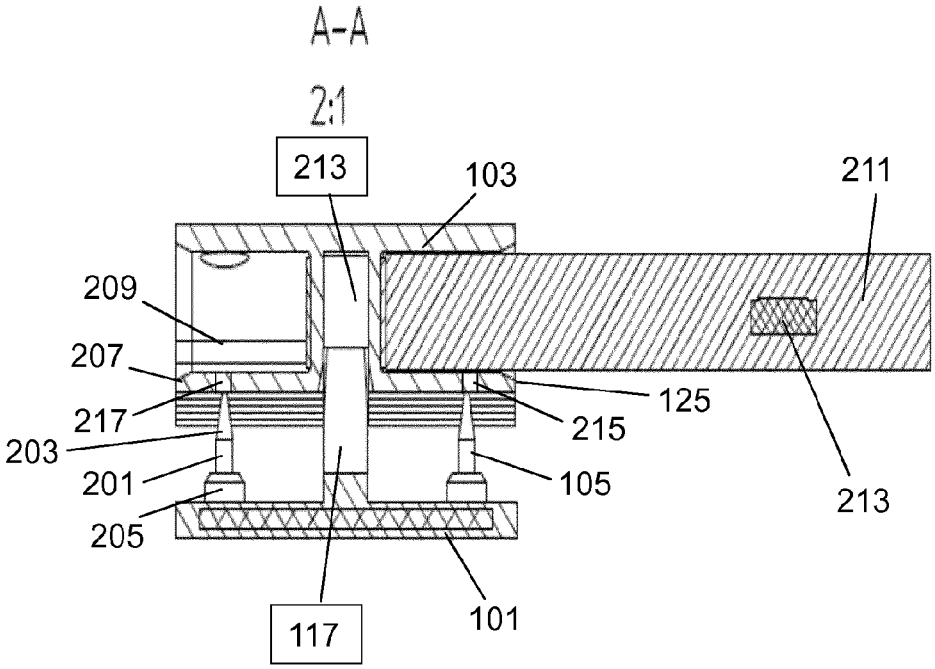
FIG. 2 shows a cross section of a spike connector according to one embodiment.

FIG. 2 shows a cross section of a spike connector in accordance with one embodiment. The spike connector illustrated in FIG. 2 is provided for the connection of conducting tracks of different electrical line pieces and comprises the features of the spike connector illustrated in FIG. 1 in accordance with one embodiment.

As illustrated in FIG. 2, the spike connector comprises a second conductive spike 201, which has a protrusion 203, for example a spike tip, and is conductively connected to the first conductive spike 105. The second conductive spike 201 is connected by means of a first guide receptacle 205 to the base element 101.

The base mating element 103 comprises a second guide receptacle 207, which is provided for receiving a second electrical line piece having the electrical conducting track 209 illustrated by way of example in FIG. 2. The first electrical line piece 211, which is positioned by means of the guide receptacle 125, likewise comprises at least one electrical conducting track, which by way of example contacts an LED 213.

The conductive spikes 105 and 201 are tapered by way of example and are provided to break through the conducting tracks of the line pieces so as to electrically contact these. To this end, the base element 103 comprises guide recesses 215, 217, through which the conductive spikes 105, 201 are guided. To this end, the base element 101 and the base mating element 103 are brought together and are interconnected by means of the spring/groove connection to form a pocket-shaped housing, which can be electrically insulating, as is illustrated in FIGS. 3A, 3B and 3C.

Portions 219, which are guided in guide channels 221, can be provided on each side. The portions 219 may each be terminated by a detent protrusion for the latching of the base element 101 and of the base mating element 103.

Figure 3A:
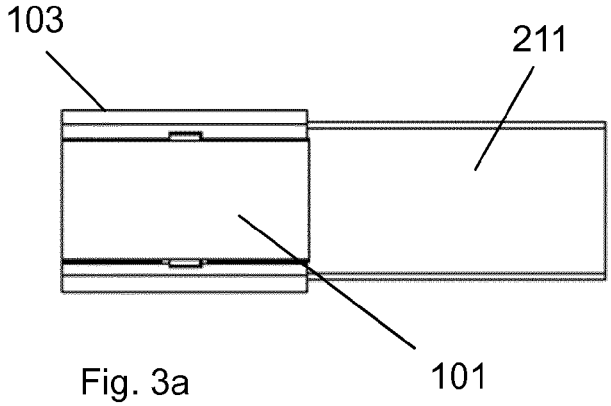
FIG. 3A shows a view of the spike connector.
Figure 3B:
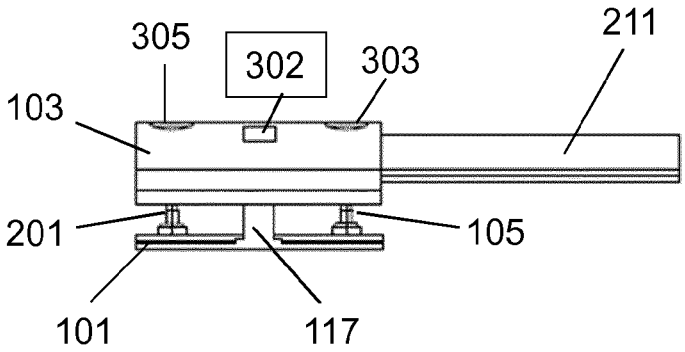
FIG. 3B shows a view of the spike connector.
Figure 3C:
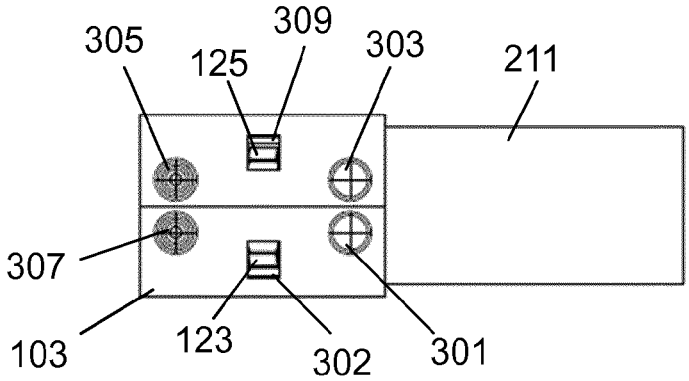
FIG. 3C shows a view of the spike connector.

FIG. 3A illustrates a view from beneath, FIG. 3B illustrates a view from the side, and FIG. 3C illustrates a view from above of the spike connector once the base element 101 and the base mating element 103 have been successfully brought together.

The electrical line pieces can be rectangular LED bands for example, which are to be interconnected. Only the first electrical line piece 211 is illustrated in FIGS. 3A, 3B and 3C for simplification.

As is illustrated in FIG. 3C, the base mating element on the upper side comprises guide recesses 301, 303, 305 and 307, which are provided to receive a total of four conductive spikes so as to electrically contact two electrical conducting tracks, running parallel, of line pieces. The conductive spikes opposite one another in the longitudinal direction are preferably electrically connected. Further, recesses 302, 309 for receiving detent protrusions 311, 319 of the portions 219 are provided laterally.

Figure 4A:
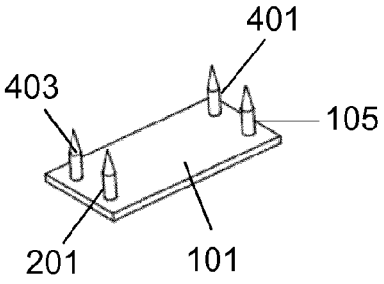
FIGS. 4A to 4F show elements of the spike connector illustrated in FIG. 2.
Figure 4B:
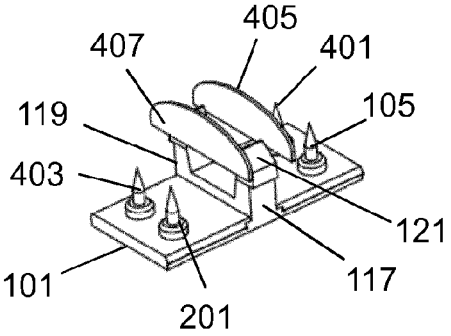
Figure 4C:
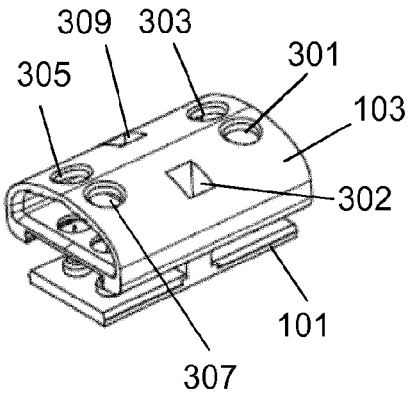
Figure 4D:
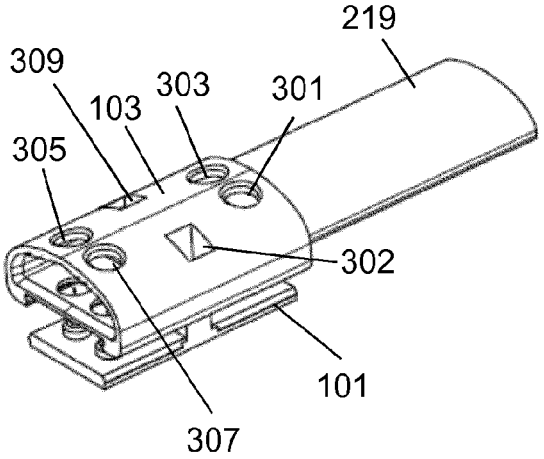
Figure 4E:
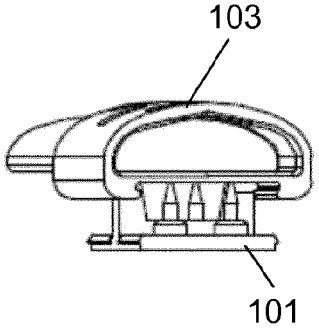
Figure 4F:
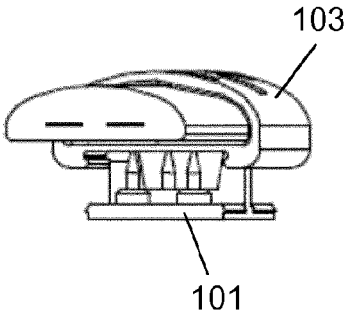

Elements of the spike connector illustrated in FIG. 2 are shown in FIGS. 4A to 4F. As illustrated in FIG. 4A, the base plate 101 comprises the first conductive spike 105, the second conductive spike 201, a third conductive spike 401 and a fourth conductive spike 403. The conductive spikes 105 and 201 are arranged opposite one another in the longitudinal direction of the base element and for example are conductively connected to form a spike pair. The conductive spikes 401 and 403 are likewise connected conductively to form a further spike pair. Two conducting tracks can thus be electrically connected by different line pieces.

The electrical spike connector may further have insulation leaves 405, 407, which can be inserted and are provided to insulate end faces of the electrical line pieces along the cut edges.

The base plate 101 may further have portions 409, 411, which each terminate via a detent protrusion 413, 415. The detent protrusions 413, 415 latch into the recesses 302, 309.

Figure 5:
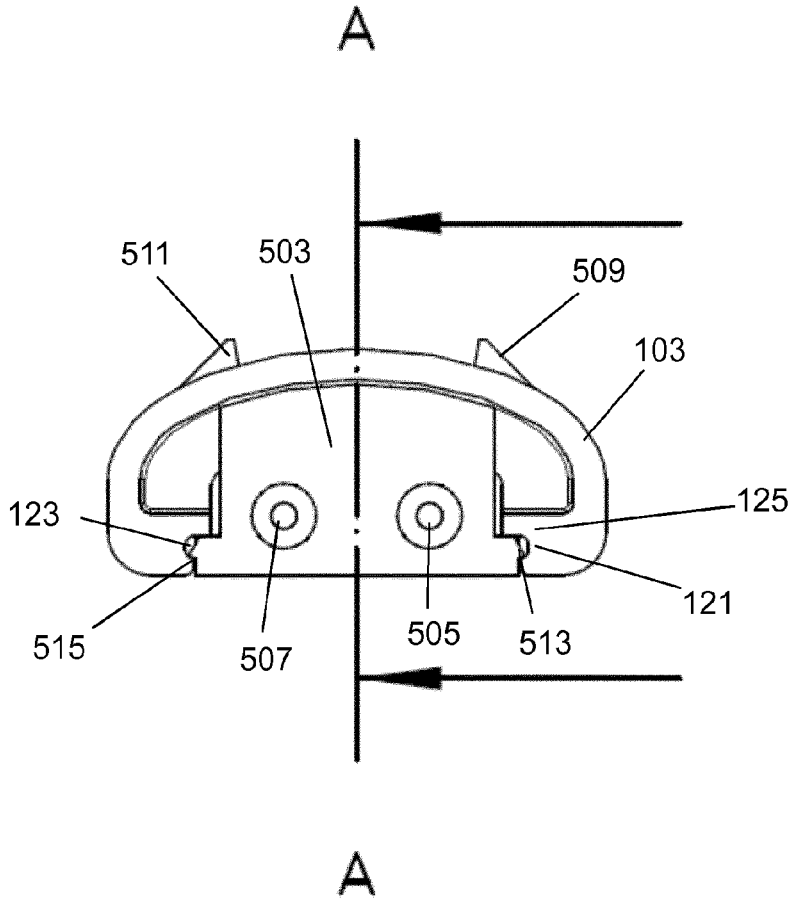
FIG. 5 shows a spike connector with a base element.

FIG. 5 shows a spike connector having a base element 501, which may have features of the previously described base elements. The base element 501 is provided with a connector 503, which enables electrical contact to the electrical conducting tracks contacted by means of the conductive spikes. To this end, the connector 503 comprises a first connector terminal 505 for contacting a first conducting track and a second connector terminal 507 for contacting a second conducting track. The connector terminals 505 and 507 may be provided for example to receive electrical lines. In accordance with one embodiment, the connector terminals 505, 507 are permanently connected to electrical lines.

As also illustrated in FIG. 5, the base element 501 or the connector 503 for the detent connection to the base mating element 103 may have resilient detent protrusions 509, 511, for example detent lugs, which can engage with apertures in the base mating element 103.

The base element 501 may also have lateral springs 513, 515, which can engage with lateral grooves 124, 125 in the base mating element 103.

Figure 6:
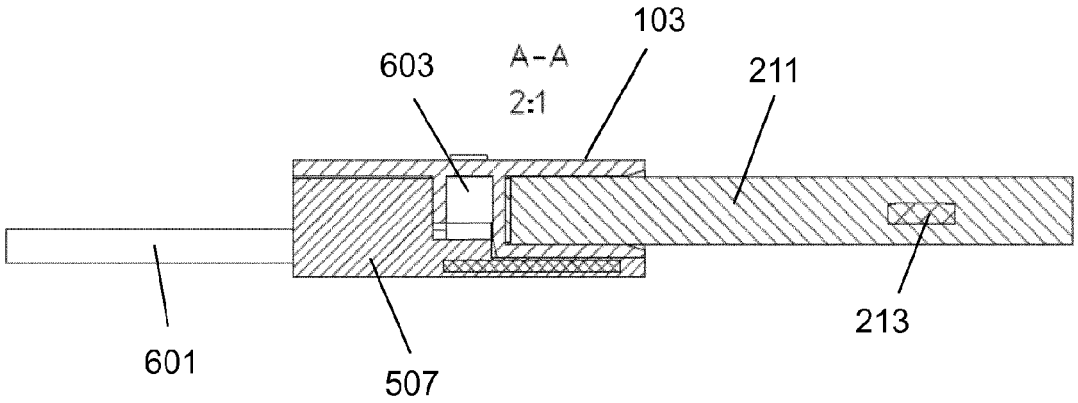
FIG. 6 shows a side view of the spike connector illustrated in FIG. 1.

FIG. 6 shows a side view of the spike connector illustrated in FIG. 1. The connector 503 is provided with at least one line piece 601, which enables the contact to the electrical conducting track of the electrical line piece illustrated by way of example.

Figure 7A:
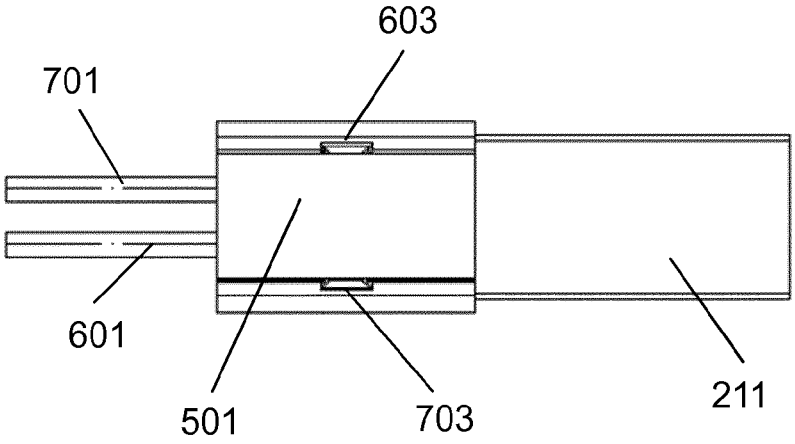
FIGS. 7A, 7B and 7C show views of the spike connector illustrated in FIGS. 5 and 6.
Figure 7B:
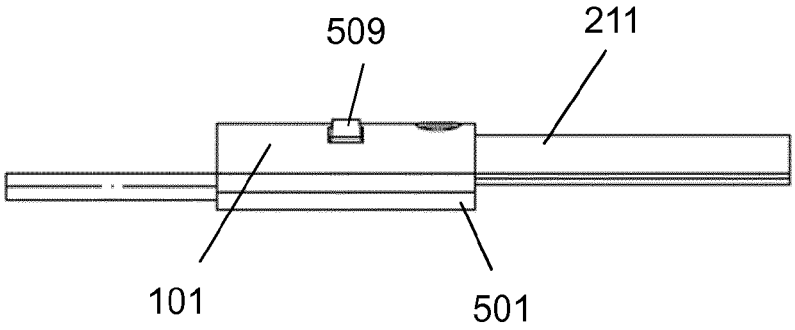
Figure 7C:
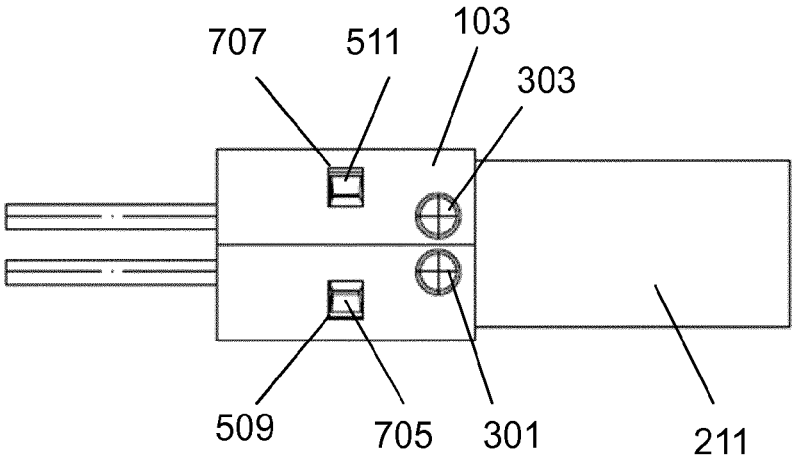

Different views of the spike connector illustrated in FIGS. 5 and 6 are illustrated in FIGS. 7A, 7B and 7C. As is illustrated in FIG. 7A, the connector 501 is provided with two electrical line pieces 601, 607, which enable a contact to the conducting tracks of the electrical line piece 211. The base element 501 is formed by way of example as a flat plate, to which lateral detent portions 603, 703 are fastened.

As illustrated in FIG. 7C, the base mating element 103 comprises detent recesses 705, 707, with which the detent protrusions 509, 511 engage.

Figure 8A:
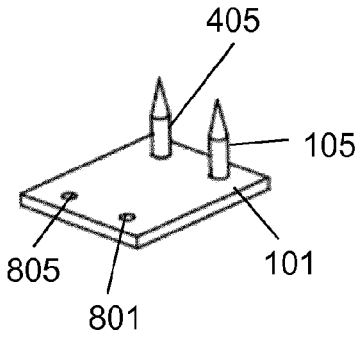
FIGS. 8A to 8F show views of elements of the spike connector illustrated in FIGS. 5 to 7.

Different views of elements of the spike connector illustrated in FIGS. 5 to 7 are illustrated in FIGS. 8A to 8F. As illustrated in FIG. 8A, the base element 101 comprises two conductive spikes 105, 405, which may have the above-mentioned spike properties. The conductive spikes 105, 405 are provided to contact two parallel conducting tracks of a line piece, for example of an LED band. The base element 101 further comprises connectors 801, 805, each of which is connected to one of the conductive spikes 105, 405 and each of which is provided for contacting by means of the connector 501.

Figure 8B:
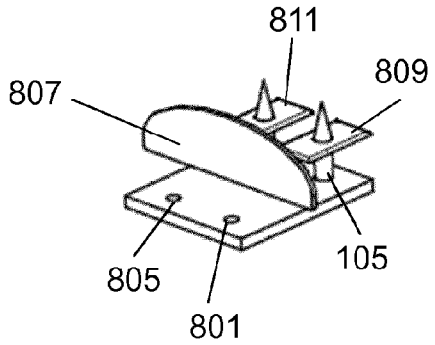

The electrical spike connector may further have an insulation leaf 807 in order to terminate end faces of the conducting tracks 809, 811. As illustrated in FIG. 8B, the conducting tracks 809, 811 are broken through by means of the conductive spikes 104, 405, whereby electrical contacts are produced. The insulation leaf 807 is preferably formed such that it can surround an end face of the respective line piece so as to insulate it with respect to moisture. The insulation leaf 807 for this purpose may be constructed from a flowable plastic, for example from plastic containing silicone. The cut edges or ends of the line piece are thus protected against moisture.

Figure 8C:
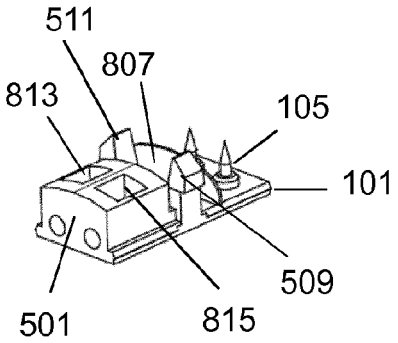
Figure 8D:
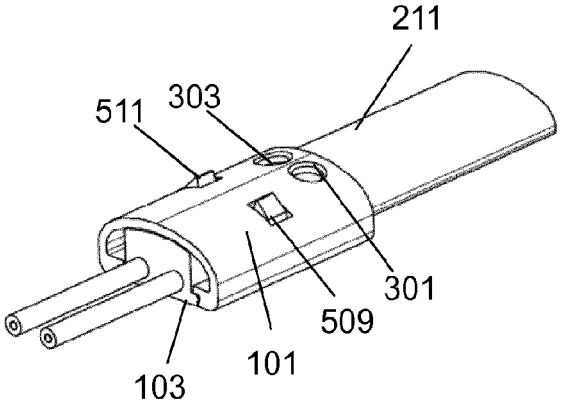
Figure 8E:
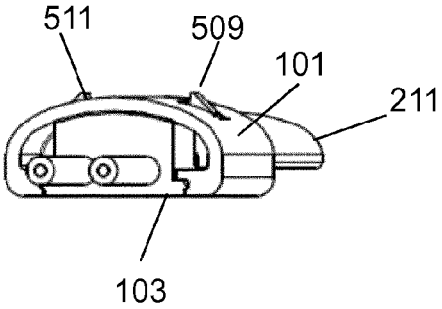
Figure 8F:
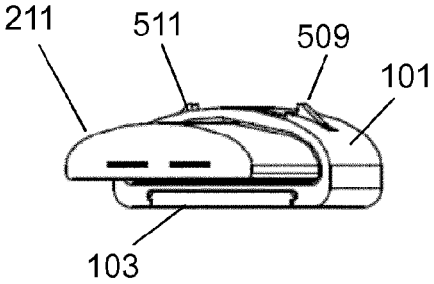

As is illustrated in FIG. 8C, the electrical connector 501 may have recesses 813, 815, in each of which force-locked connections, for example clamp connections or screw connections, for line pieces to be received are arranged.

LIST OF REFERENCE SIGNS

101 base element
103 base mating element
105 first conductive spike
107 tapered portion
109 spike receptacle
111 third conductive spike
113 tapered portion
115 spike receptacle
117 connection portion
119 connection portion
121 spring
123 spring
124 lateral groove
125 lateral groove
127 line piece receptacle
128 intermediate space
129 lateral spring
131 lateral spring
201 second conductive spike
203 taper
205 receptacle
207 guide receptacle
209 electrical conducting track
211 first electrical line piece
213 LED
215 guide recess
217 guide recess
219 portion
221 guide channel
301 guide recess
302 recess
303 guide recess
305 guide recess
307 guide recess
309 recess
401 third conductive spike
403 fourth conductive spike
405 insulation leaf
407 insulation leaf
409, 411 portions
413, 415 detent protrusions
501 base element
503 connector
505 first connector terminal
507 second connector terminal
509 detent lug
511 detent lug
513 spring
515 spring
601 line piece
701 line piece
705 detent recess
707 detent recess
801 connector
805 connector
807 insulation leaf
809 conducting track
811 conducting track
813 recess
815 recess From the foregoing description, those skilled in the art can appreciate that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

The invention claimed is:

1. An electrical spike connector for electrically contacting a first electrical conducting track of a first electrical line piece, comprising:

a first electrical conducting track being insulated by an insulating layer;

a base element having a first conductive spike;

a base mating element for retaining the first electrical line piece; wherein the first conductive spike of the base element is pressed against the first electrical line piece retained in the base mating element to pierce the insulating layer and to electrically contact the first electrical conducting track.

2. The electrical spike connector of claim 1, wherein at least one of (i) a surface of the base element facing the electrical line piece, and (ii) a surface of the base mating elements facing the electrical line piece is provided with at least one of flowable plastic and plastic containing silicone, to at least partially receive the electrical line piece in a manner surrounding said electrical line piece.

3. The electrical spike connector as of claim 1, wherein the first conductive spike can be pressed against the first electrical line piece retained in the base mating element by bringing together the base element and the base mating element.

4. The electrical spike connector of claim 1, wherein the base element and the base mating element can be connected by at least one of a detent connection and a form-fit connection.

5. The electrical spike connector of claim 1, wherein the base element and the base mating element are capable of being non-detachably connected.

6. The electrical spike connector of claim 1, wherein the base element includes at least one of (i) at least one detent protrusion and (ii) at least one detent recess for a detent connection to the base mating element.

7. The electrical spike connector of claim 1, wherein the base element includes a spring on each side, wherein the base mating element includes a groove on each side, and wherein each spring is capable of being latched into a groove.

8. The electrical spike connector of claim 1, wherein the base mating element is capable of being fastened laterally on the base element in a foldable manner by at least one of at least one resilient connection tab and at least one hinge.

9. The electrical spike connector of claim 1, wherein the base mating element includes at least one guide recess for guiding the respective conductive spike.

10. The electrical spike connector of claim 1, wherein the base mating element descends laterally to the respective side in a dome-like manner.

11. The electrical spike connector of claim 1, wherein the base mating element includes a line piece receptacle for receiving the respective electrical line piece.

12. The electrical spike connector of claim 1, further includes an insertable insulation leaf to insulate an end face of the respective electrical conducting track with respect to moisture.

13. The electrical spike connector of claim 1, wherein the respective conducting track is a strip conducting track.

14. The electrical spike connector of claim 1, wherein the base element and the base mating element form at least one of (i) a pocket-shaped housing and (ii) a water-tight housing when brought together.

15. A method for contacting at least one strip-shaped conducting track of an LED band utilizing the electrical spike connector of claim 1.

16. The electrical spike connector of claim 1, wherein the first conductive spike is designed to deform the first electrical conducting track to produce an electrical contact.

17. The electrical spike connector of claim 16, wherein the first conductive spike includes a spike tip for at least one of (i) piercing and (ii) breaking through the first electrical conducting track to produce the electrical contact.

18. The electrical spike connector of claim 16, wherein the first conductive spike is designed to form a breakthrough-free cavity, in the first electrical conducting track to produce the electrical contact.

19. The electrical spike connector of claim 1, wherein the base mating element is provided with a second electrical conducting track, which is insulated by a second insulating layer, to retain a second electrical line piece; wherein the base element includes a second conductive spike, which can be pressed against the second electrical line piece retained in the base mating element to pierce the second insulating layer and to electrically contact the second electrical conducting track; and wherein the first conductive spike and the second conductive spike are electrically connected and are provided to electrically connect the first electrical conducting track and the second electrical conducting track.

20. The electrical spike connector claim 19, wherein the first conductive spike and the second conductive spike are arranged opposite one another.

21. The electrical spike connector of claim 19, wherein the first electrical line piece includes an insulated third electrical conducting track, wherein the second electrical line piece includes an insulated fourth electrical conducting track, and wherein the base element includes a third conductive spike for electrically contacting the insulated third electrical conducting track and a fourth conductive spike for electrically contacting the insulated fourth electrical conducting track, wherein the third and the fourth conductive spike are conductively connected.

22. The electrical spike connector of claim 21, wherein the base element includes an electrical connector that is conductively connected to the respective first, third, and fourth conductive spikes and is provided for contacting the respective electrical conducting track.

* * * * *